United States Patent [19]

Byrt et al.

[11] 4,267,752

[45] May 19, 1981

[54] CUTTING APPARATUS FOR CONTINUOUS WEBS

[75] Inventors: Graham A. B. Byrt; Kenneth Chandler, both of Bristol, England

[73] Assignee: Masson Scott Thrissell Engineering, Bristol, England

[21] Appl. No.: 122,342

[22] Filed: Feb. 19, 1980

[30] Foreign Application Priority Data

Feb. 20, 1979 [GB] United Kingdom ..... 6015/79

[51] Int. Cl.[3] ..... B26D 1/36; B26D 1/38; B26D 5/20

[52] U.S. Cl. ..... 83/74; 83/76; 83/311; 83/312; 83/339; 83/364; 83/365; 83/367; 83/650

[58] Field of Search ..... 83/74, 76, 364, 365, 83/367, 312, 339, 650, 311

[56] References Cited

U.S. PATENT DOCUMENTS 1,961,538 6/1934 Weber ..... 83/74

2,038,452 4/1936 Sharkey et al. ..... 83/74 X 2,283,096 5/1942 Sandberg ..... 83/74

3,498,165 3/1970 Austin ..... 83/650 X

*Primary Examiner*—Frank T. Yost

*Attorney, Agent, or Firm*—Seidel, Gonda, Goldhammer & Panitch

[57] ABSTRACT

A paper sheeter for cutting two or more webs simultaneously into sheets has a rotary knife to make the cuts in desired register with marks (e.g. watermarks) carried by the web. A sensor is provided for detecting the marks on each web and a further sensor monitors the knife rotation; signals from the several sensors are fed to a control unit in which the signals from each mark sensor are compared with signals from the knife sensor to produce feed control signals for the respective web. These control signals may be applied to brakes associated with the web supply reels to vary the tension in each web; alternatively one web may be controlled by using the control signals to vary the speed ratio between the knife and pull rolls feeding the webs to the knife.

8 Claims, 2 Drawing Figures

FIG. 1
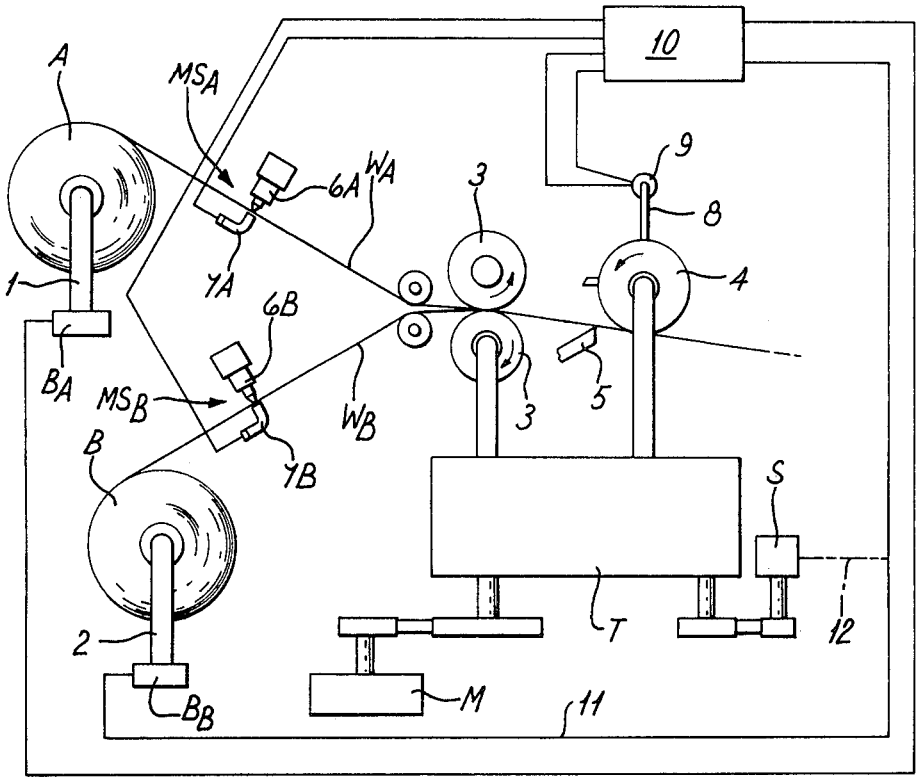
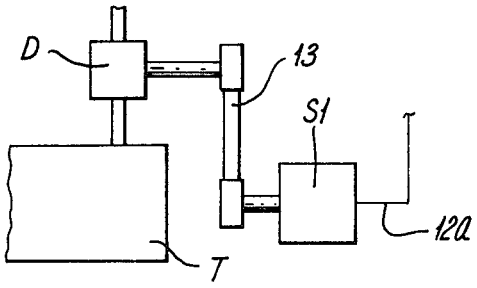
FIG. 2

CUTTING APPARATUS FOR CONTINUOUS WEBS

This invention relates to apparatus for cutting continuous webs of paper or the like into a succession of sheets, and more particularly to such apparatus in which cutting is effected at desired positions relative to marks (e.g. watermarks) carried by the web.

In any apparatus for cutting a continuous web into a succession of sheets, the ratio between cutter speed and web speed is governed by the desired sheet length; it has been a common practice therefore to drive both the web and the knife from a single prime mover (usually an electric motor) through drive connections including a variable gearing by which the appropriate cutter speed/web speed ratio may be set. In recent years an alternative arrangement has become known, in which separate electric motors are provided to drive the web and the knife, with electrical/electronic control devices to maintain a speed ratio corresponding to the desired sheet length.

When cutting is required to be at positions in selected relation to marks carried by the web (hereinafter termed "register marks"), it is necessary to sense the presence of the register marks and the presence of the knife as they move past respective sensing positions and if comparison of the results of such sensing indicates that the cut will not be placed as desired relative to the register marks, then the speed of the web or of the knife needs to be temporarily altered until the error is corrected. With a purely mechanical drive for the web and knife from a single prime mover, the error may be corrected by a temporary variation of the gear ratio which determines sheet length; alternatively, the correction may be introduced through a differential gear in one of the drive connections.

It is an object of the present invention to provide apparatus for cutting continuous webs of paper or the like into sheets, cutting being affected at desired positions relative to register marks carried by the web, in which at least two webs can be fed and cut simultaneously.

According to the invention, there is provided apparatus for cutting a plurality of webs of paper or the like simultaneously to form a succession of sheets, including support means for an equal plurality of supply reels of web to be cut; a pair of pull rollers for pulling web from the supply reels; a rotary knife disposed to receive all of the webs from the pull rollers; a mark sensor for each web arranged to emit a detection signal on sensing each register mark on that web; a knife sensor arranged to emit reference signals representing rotation of said knife; drive means for said pull rollers and said knife, and control means arranged to receive said detection signals from the mark sensors and said reference signals from the knife sensor, and to derive from the detection signals from each mark sensor, by comparison with said reference signals, feed control signals from the respective web, said feed control signals being applied to means for modifying the rate of feed of each web to the knife means to maintain the detection signals from the mark sensors in the desired relationship to the reference signals from the knife sensor so that a desired constant sheet length is produced.

The modifying means may maintain the detection signals from the web sensors in phase with the reference signals from the knife sensor to produce a constant sheet length equal to the spacing of the register marks.

Conveniently the modifying means may include braking means for each of said supply reels, each braking means being arranged to receive and respond to said feed control signals for the web associated with that braking means so as to affect the rate of feed of that web.

In a modified form of apparatus the modifying means may include braking means for all but one of said supply reels and first transmission means in said driving means for producing a variable controlled mean speed ratio between said rollers and said knife, each of said braking means being arranged to receive and respond to said feed control signals for the web associated with that braking means so as to affect the rate of feed of that web, the feed control signals for the web associated with said one supply reel being applied to said drive means to vary the mean speed ratio between said pull rollers and said knife.

To give a fuller understanding of the invention, preferred embodiments thereof will now be described by way of example only, with reference to the accompanying drawings in which, FIG. 1 is a diagrammatic view of paper cutting apparatus embodying the invention, and FIG. 2 is a diagrammatic view showing a modified form of part of the apparatus shown in FIG. 1.

As illustrated the apparatus includes supports 1, 2 for two supply reels, A, B from each of which a paper web ($W_A$, $W_B$ respectively) is drawn by the action of a pair of pull rolls 3 which nip the two webs $W_A$, $W_B$ and feed the two webs forward to a rotary knife 4 which coacts with a dead knife 5 to cut the webs transversely at regular intervals to produce a succession of pairs of sheets. Each of the supports 1, 2 is provided with a respective brake $B_A$, $B_B$ by which the tension of the associated web $W_A$, $W_B$ may be controlled.

The pull rolls 3 and rotary knife 4 are driven from a common motor M via a transmission unit T containing variable-ratio gearing by which the speed ratio between the knife 4 and the pull rolls 3 may be varied; an auxiliary motor S is coupled to the unit T for adjustment of said speed ratio.

Mark sensing assemblies $MS_A$, $MS_B$ are placed astride the runs of webs $W_A$, $W_B$ respectively between the supply reels A, B and the pull rolls 3. Each mark sensing assembly comprises respectively an illuminator 6A, 6B and a photo-electric transducer 7A, 7B. A shaft 8 carries the rotary knife 4 and said shaft 8 also drives a knife sensor in the form of an encoder 9. The encoder 9 and both the transducers 7A, 7B are connected to inputs of a control unit 10, which has two outputs; one of said outputs is connected to the brake BA, the second of said outputs being connected (as shown by the connection 11 in full line) to the brake $B_B$. The second output may alternatively be connected to the motor S (as shown by the connection 12 in dashed line).

In operation of the apparatus described above, as the webs $W_A$, $W_B$ feed from reels A, B towards the rotary knife 4, watermarks or other register marks on each web are sensed as they pass the respective sensing assemblies and the transducers 7A, 7B emit signals which are received in the control unit 10, which also receives from the encoder 9 signals representing successive positions of the knife 4 as it rotates. Within the unit 10, the signals from each of the transducers 7A, 7B are compared so as to determine whether the knife 4 will cut the respective web at the right position relative to the sensed marks. Whenever the result of this comparison indicates that the position of the cut will be in error, a control signal appears at the corresponding output of the unit 10. If the error is indicated in relation to the cutting of web $W_A$ (i.e. is derived from comparing a signal from transducer 7A) then the control signal appears at the output connected to brake $B_A$, causing that brake to relax or increase tension in web $W_A$ in such sense as to reduce the error; if the error appears in relation to web $W_B$ (i.e. from comparing the signal from transducer 7B) then the control signal appears at the other output of unit 10, connected to brake $B_B$, and affects the tension in web $W_B$.

With the alternative arrangement in which the second output of unit 10 is connected to the motor S, the speed of the knife 4 is altered (by variation of the speed ratio, provided by transmission unit T, between the knife 4 and pull rollers 3) when a control signal is delivered by the second output of unit 10, and while this provides correction of error in the cutting of web $W_B$, it also necessarily affects the cutting of web $W_A$, so a control signal is also emitted from the first output of unit 10 to effect a balancing change in tension of web $W_A$ by means of brake $B_A$.

The unit 10 may comprise various forms of control circuits; the transducers 7A, 7B and encoder 9 must of course be matched to the circuits employed. In the drawing, it is noted that the encoder 9 is shown as connected to the unit 10 by a double connection, and this double connection is required when a preferred form of encoder is used, which emits a pulse to the unit 10 (the "cut position pulse") on a first line at the instant each cut of the knife 4 occurs (once per knife revolution) while on the second line of the double connection the encoder emits a continuous succession of regularly-spaced pulses at a frequency directly proportional to the knife speed (i.e. a constant number of pulses per knife revolution). The latter pulses may, within the unit 1), be fed to a digital counter which is reset whenever a cut position pulse is received on the first line, so that the number stored in the counter at any instant is directly related to the instantaneous angular position of the knife 4.

When a mark is sensed, e.g. by transducer 7A, and a signal is emitted by that transducer, within the unit 10 that signal may cause the number in the digital counter to be read out and compared with a stored number, which is preselected so as to be equal to the stored number if the knife position is correct at the instant the mark is sensed so that no control signal need be emitted if the comparison shows equality. However, in the event that the result of the comparison shows the numbers compared to be unequal, a control signal representative (in magnitude and sign) of the difference is required to be emitted to brake $B_A$; it is therefore convenient to perform comparison by subtraction and then to apply the difference to a digital to analogue converter.

The above is a brief indication of one possible form which the circuits in unit 10 may take; it will be understood that various other arrangements are available.

In a modified form of apparatus shown in FIG. 2, the second output of unit 10 is connected to motor S1 by connection 12*a*. In this case the motor S1 is not coupled to unit T for adjustment of the speed ratio between the knife 4 and the pull rolls 3, but is coupled to a differential gear D by means of a drive belt 13, the gear D being coupled to and positioned between the unit T and the knife 4.

We claim:

1. Apparatus for cutting a plurality of webs of paper or the like simultaneously to form a succession of sheets, including support means for an equal plurality of supply reels of web to be cut, a pair of pull rollers for pulling web from the supply reels, a rotary knife disposed to receive all of the webs from the pull rollers, a mark sensor from each web arranged to emit a detection signal on sensing each register mark on the web, a knife sensor arranged to emit reference signals representing rotation of said knife, drive means for said pull rollers and said knife, modifying means for each web, and control means arranged to receive said detection signals from the mark sensors and said reference signals from the knife sensor and to derive from the detection signals from each mark sensor, by comparison with said reference signals, feed control signals for the respective web, said feed control signals being applied to said modifying means for modifying the rate of feed of each web to the knife means to maintain the detection signals from the mark sensors in the desired relationship to the reference signals from the knife sensor so that a desired constant sheet length is produced.

2. Apparatus as claimed in claim 1 wherein the modifying means maintain the detection signals from the web sensors in phase with the reference signals from the knife sensor to produce a constant sheet length equal to the spacing of the register marks.

3. Apparatus as claimed in claim 1 in which said modifying means includes braking means for each of said supply reels, each braking means being arranged to receive and respond to said feed control signals from the web associated with that braking means so as to affect the rate of feed of that web.

4. Apparatus as claimed in claim 1 in which said modifying means includes braking means for all but one of said supply reels and first transmission means in said driving means for producing a variable controlled mean speed ratio between said rollers and said knife, each of said braking means being arranged to receive and respond to said feed control signals for the web associated with that braking means so as to affect the rate of that web, the feed control signals for the web associated with said one supply reel being applied to said drive means to vary the mean speed ratio between said pull rollers and said knife.

5. Apparatus as claimed in claim 4 in which said drive means further includes auxiliary means coupled to said first transmission means to vary said mean speed ratio produced by said first transmission means, wherein the feed control signals for the web associated with said one supply reel are applied to said auxiliary means.

6. Apparatus as claimed in claim 4 in which said drive means includes second transmission means for producing a variable controlled speed ratio connected in series with said first transmission means so that the speed ratio between said rollers and said knife is the overall speed ratio produced by said first and second transmission means and further includes auxiliary means coupled to said second transmission means wherein the feed control signals for the web associated with said one supply reel are applied to said auxiliary means to vary the speed ratio produced by said second transmission means.

7. Apparatus as claimed in 6 in which said second transmission means is a differential gear.

8. Apparatus as claimed in claim 7 in which said first transmission means is a variable speed gearbox.

* * * * *